US006735976B2

(12) United States Patent
Lee

(10) Patent No.: US 6,735,976 B2
(45) Date of Patent: May 18, 2004

(54) REFRIGERATOR

(75) Inventor: Jae-Seung Lee, Kwangju (KR)

(73) Assignee: Samsung Electronics Co., Ltd, Suwon-si (KR)

( * ) Notice: Subject to any disclaimer, the term of this patent is extended or adjusted under 35 U.S.C. 154(b) by 0 days.

(21) Appl. No.: 10/382,857

(22) Filed: Mar. 7, 2003

(65) Prior Publication Data

US 2004/0040335 A1 Mar. 4, 2004

(30) Foreign Application Priority Data

Aug. 31, 2002 (KR) ..... 2002-52256

(51) Int. Cl.[7] ..... F25D 17/06
(52) U.S. Cl. ..... 62/419; 62/442
(58) Field of Search ..... 62/419, 442, 187, 62/97, 329

(56) References Cited

U.S. PATENT DOCUMENTS

| | | | | | |
|---|---|---|---|---|---|
| 2,812,642 | A | * | 11/1957 | Jacobs | 62/155 |
| 3,126,716 | A | * | 3/1964 | Witte | 62/156 |
| 3,590,594 | A | * | 7/1971 | Arend | 62/187 |
| 3,745,786 | A | * | 7/1973 | Laughlin et al. | 62/419 |
| 3,834,176 | A | * | 9/1974 | Clarke | 62/276 |
| 3,834,177 | A | * | 9/1974 | Scarlett | 62/288 |
| 3,893,307 | A | * | 7/1975 | Jacobs | 62/150 |
| 3,992,171 | A | * | 11/1976 | Jenewein | 62/419 |
| 4,741,175 | A | * | 5/1988 | Schulze | 62/442 |
| 5,729,997 | A | | 3/1998 | Witsoe | |

FOREIGN PATENT DOCUMENTS

| | | |
|---|---|---|
| KR | 1999-19291 | 3/1999 |
| KR | 10-288258 | 2/2001 |

* cited by examiner

*Primary Examiner*—Melvin Jones
(74) *Attorney, Agent, or Firm*—Staas & Halsey LLP

(57) ABSTRACT

A refrigerator designed to enlarge the interior capacity of a storage compartment and to enhance the circulating efficiency of cool air. The refrigerator includes a cabinet, a projecting part, an evaporator, a cool air circulating fan, and a machine room. The cabinet is provided with a storage compartment. The projecting part is upwardly projected from a predetermined position on the upper portion of the cabinet to define an air cooling chamber, and the air cooling chamber is defined in an upward direction from the upper portion of the storage compartment. The evaporator and cool air circulating fan are installed in the air cooling chamber defined in the projecting part. The machine room is provided on the upper portion of the cabinet at a position opposed to the projecting part. A compressor and a condenser are installed in the machine room.

18 Claims, 3 Drawing Sheets

REFRIGERATOR

CROSS-REFERENCE TO RELATED APPLICATION

This application claims the benefit of Korean Application No. 2002-52256, filed Aug. 31, 2002, in the Korean Industrial Property Office, the disclosure of which is incorporated herein by reference.

BACKGROUND OF THE INVENTION

1. Field of the Invention

The present invention relates, in general, to refrigerators and, more particularly, to a refrigerator which is designed such that an air cooling chamber and a machine room are provided on the upper portion of a cabinet, thus enlarging a storage space of the refrigerator.

2. Description of the Related Art

As is well known to those skilled in the art, a refrigerator is an appliance which is operated such that cool air generated from an evaporator is supplied to a storage compartment, thus maintaining the freshness of various food items for a lengthy period of time. Recently, as consumers have an increased preference for large-capacity storage compartments, there is a growing tendency for the size of refrigerators to be increased. For example, there has been proposed a side-by-side refrigerator, which is provided on its left side with a freezer compartment and on its right side with a refrigerator compartment so as to allow a large quantity of foods to be preserved for a lengthy period of time.

The side-by-side refrigerator is designed such that its storage compartment is partitioned by a partition wall so as to define the freezer compartment and the refrigerator compartment at both sides in the interior of the refrigerator's cabinet. A freezer door is mounted to the front of the freezer compartment to open or close the freezer compartment, and a storage door is mounted to the front of the refrigerator compartment to open or close the refrigerator compartment. The freezer compartment, refrigerator compartment and the two doors are provided with a plurality of shelves and drawers so as to easily store foods in the refrigerator. An evaporator, a cool air circulating fan and a cool air duct defining a cool air passage are interiorly installed on each of the rear walls of the freezer compartment and refrigerator compartment to supply cool air into an associated compartment. A plurality of cool air outlet ports and cool air inlet ports are provided on the front surface of the cool air duct. A machine room is provided at a rear portion in the lower portion of the cabinet, and receives a condenser, a compressor, a cooling fan, etc.

However, such a conventional large-capacity refrigerator has a problem that the evaporator to generate cool air and the cool air circulating fan to circulate cool air are installed at each of the rear positions inside the freezer compartment and the refrigerator compartment, and the machine room receiving the compressor and the condenser is arranged at the rear portion in the lower portion of the cabinet, so the interior capacities of the freezer compartment and the refrigerator compartment are reduced.

Further, since the large-capacity refrigerator is tall, it is inconvenient to a short user while storing or taking food out of the upper portion of the refrigerator, so the short user prefers using the lower portion to using the upper portion of the refrigerator. But, in the conventional refrigerator, the space of the lower portion of the storage compartment is small, because the machine room is arranged at the rear portion in the lower portion of the cabinet and occupies a substantial part of the lower portion.

SUMMARY OF THE INVENTION

Accordingly, it is an aspect of the present invention to provide a refrigerator, capable of maximizing the interior capacity of a storage compartment by changing the positions of an air cooling chamber and a machine room, thereby the refrigerator being substantially easier to use.

Another aspect of the present invention is to provide a refrigerator which enhances the cool air circulating efficiency of the storage compartment.

Additional aspects and advantages of the invention will be set forth in part in the description which follows and, in part, will be obvious from the description, or may be learned by practice of the invention.

The foregoing and/or other aspects of the present invention are achieved by providing a refrigerator, including a cabinet provided with a storage compartment, a projecting part upwardly projected from a predetermined position on the upper portion of the cabinet to define an air cooling chamber, the air cooling chamber being defined in an upward direction from the upper portion of the storage compartment, an evaporator and a cool air circulating fan installed in the air cooling chamber defined in the projecting part, and a machine room provided on the upper portion of the cabinet at a position opposed to the projecting part, and including a compressor and a condenser installed.

According to an aspect of the present invention, the projecting part is provided at a rear position on the upper portion of the cabinet such that the air cooling chamber is longitudinally and horizontally arranged at a rear position above the storage compartment, and the machine room is provided in front of the projecting part.

According to another aspect of the present invention, the air cooling chamber is provided with a partition wall to partition the air cooling chamber into a front part and a rear part, the partition wall is spaced at its upper end apart from the top surface of the air cooling chamber, the evaporator and cool air circulating fan are installed in the rear part of the air cooling chamber, the cool air circulating fan is installed at a position above the evaporator so as to blow cool air, generated by the evaporator through a heat-exchanging process, into the front part of the air cooling chamber, and the cool air circulating fan comprises a cross flow fan which is longitudinally arranged along the air cooling chamber.

According to yet another aspect of the present invention, the refrigerator also includes a sucked air guide member spaced apart from the rear surface of the storage compartment in such a way that the upper end of the sucked air guide member is connected to the lower end of the partition wall, the sucked air guide member defining a guide passage to guide air of the storage compartment into the rear part of the air cooling chamber, with a plurality of sucking ports provided on the sucked air guide member, and a discharged air guide member spaced apart from the upper surface of the storage compartment in such a way that the rear end of the discharged air guide member is connected to the lower end of the partition wall, the discharged air guide member distributing cool air discharged through the front part of the air cooling chamber, with a plurality of discharging ports provided on the discharged air guide member.

According to still another aspect of the present invention, the machine room includes a casing comprising a cover member mounted to the upper portion of the cabinet for covering a top and both sides of the machine room, and a shutting member rotatably mounted to the cover member selectively opening or closing the front of the cover member.

BRIEF DESCRIPTION OF THE DRAWINGS

These and/or other aspects and advantages of the invention will become apparent and more readily appreciated from the following description of the embodiments, taken in conjunction with the accompanying drawings of which.

DETAILED DESCRIPTION OF THE PREFERRED EMBODIMENTS

Figure 1:
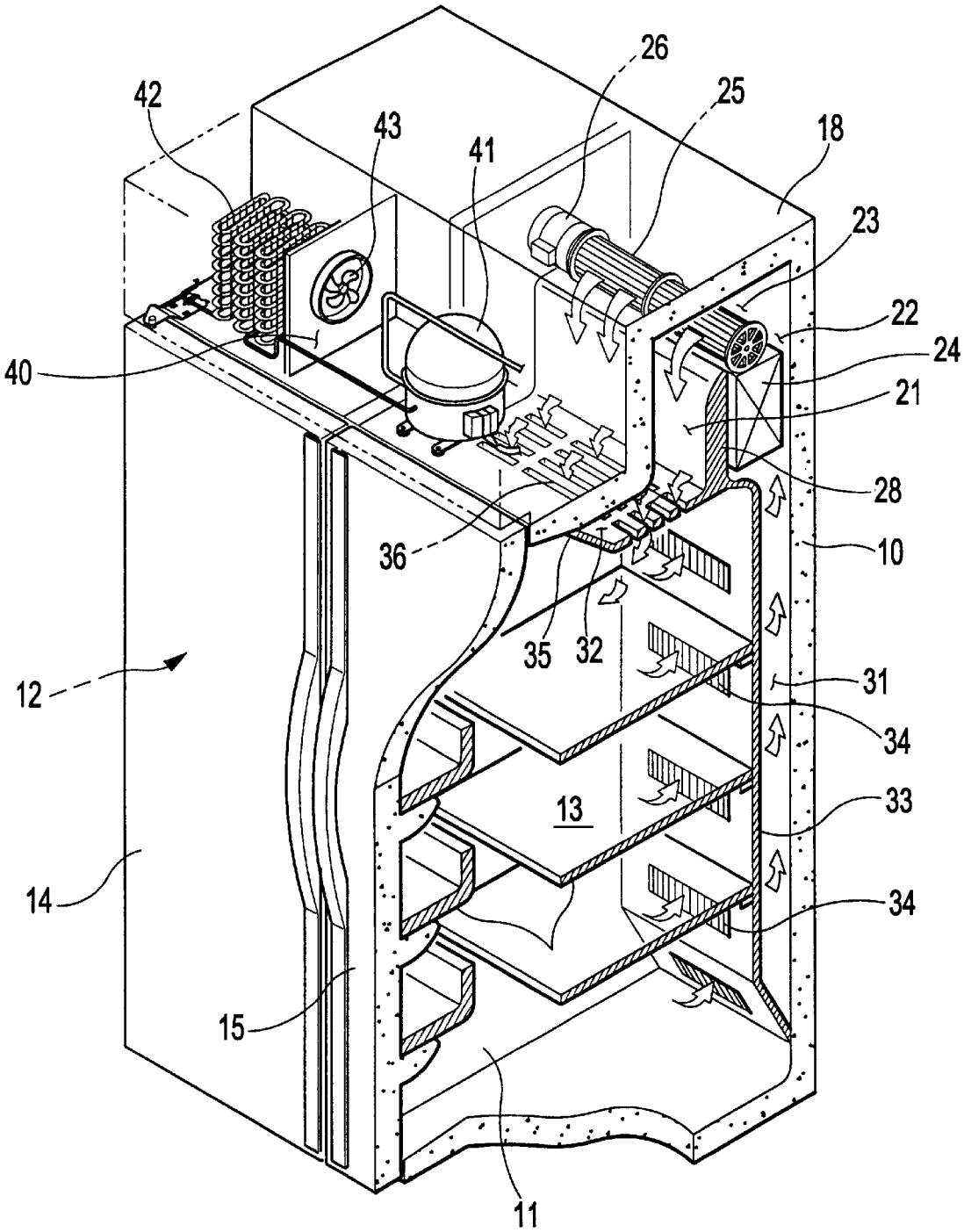
FIG. 1 is a perspective view showing a refrigerator according to an embodiment of the present invention.

Reference will now be made in detail to the embodiments of the present invention, examples of which are illustrated in the accompanying drawings, wherein like reference numerals refer to like elements throughout. The embodiments are described below in order to explain the present invention by referring to the figures.

Figure 2:
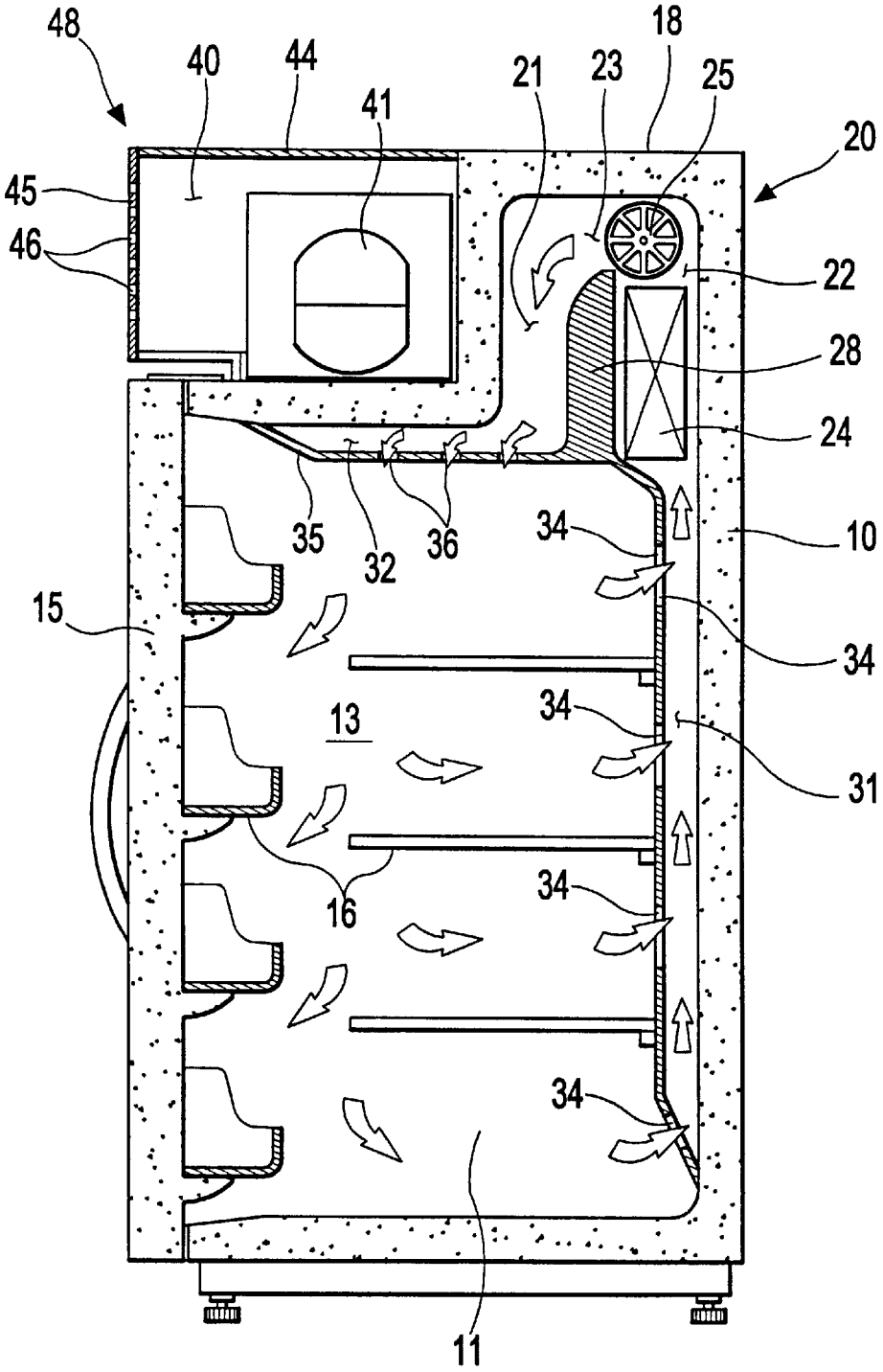
FIG. 2 is a sectional view of the refrigerator of FIG. 1.

As shown in FIGS. 1 and 2, a large-capacity refrigerator according to an embodiment of the present invention is designed such that a storage compartment in a cabinet 10 is partitioned into two sections by a partition wall 11. In this case, a freezer compartment 12 is provided on the left side of the storage compartment and a refrigerator compartment 13 is provided on the right side of the storage compartment. A freezer door 14 is mounted to the front of the freezer compartment 12 to open or close the freezer compartment 12, and a storage door 15 is mounted to the front of the refrigerator compartment 13 to open or close the refrigerator compartment 13. A plurality of shelves are installed in the freezer compartment 12, refrigerator compartment 13, freezer door 14 and the storage door 15 so as to hold food to be stored.

A projecting part 18 is upwardly projected from a predetermined position on the upper portion of the cabinet 10 to define a first air cooling chamber 20 for the freezer compartment 12 and a second air cooling chamber 20 for the refrigerator compartment 13. An evaporator 24 and a cool air circulating fan 25 are installed in each of the first and second air cooling chambers 20. The first and second air cooling chambers 20 are defined in upward directions from the rear portions of the upper portions of the freezer compartment 12 and the refrigerator compartment 13 such that the two air cooling chambers 20 are longitudinally and horizontally arranged at positions above the freezer compartment 12 and the refrigerator compartment 13. In this case, the projecting part 18 is integrated with the cabinet 10, and is made of an insulating material to insulate the air cooling chambers 20 from the outside, in the same manner as the cabinet 10. The lower portions of the first and second air cooling chambers 20 communicate with the interiors of the freezer compartment 12 and the refrigerator compartment 13, respectively.

According to the present invention, a machine room 40 is provided on the upper portion of the cabinet 10 at a position in front of the projecting part 18. A compressor 41, a condenser 42 and a cooling fan 43 are installed in the machine room 40. That is, different from a conventional refrigerator which is designed such that a machine room is provided at the rear portion in the lower portion of a cabinet, the refrigerator of the present invention is designed such that the machine room 40 is provided on the upper portion of the cabinet 10, thus enlarging the interior space of the lower portions of the freezer compartment 12 and the refrigerator compartment 13.

A partition wall 28 is installed in each air cooling chamber 20 defined by the projecting part 18, and partitions each air cooling chamber 20 into a front part 21 and a rear part 22. Each partition wall 28 is spaced at its upper end apart from the top surface of an associated air cooling chamber 20, so that the front part 21 of the air cooling chamber 20 communicates with the rear part 22 through a communicating passage 23 defined above the partition wall 28. An evaporator 24 is installed in the rear part 22 of each air cooling chamber 20 to generate cool air. A cool air circulating fan 25 is installed at a position above the evaporator 24. In this case, the cool air circulating fan 25 is horizontally and longitudinally arranged along each air cooling chamber 20. The cool air circulating fan 25 comprises a conventional cross flow fan which is designed such that its outer circumferential portion is near to the upper end of the partition wall 28. A drive motor 26 is installed at a predetermined position of the cool air circulating fan 25 to drive it. Such a construction allows air to be circulated from the rear part 22, which is provided with the evaporator 24, to the front part 21 of each air cooling chamber 20. Further, the above-mentioned construction allows cool air to be circulated throughout the communicating passage 23 so the cool air smoothly flows without any resistance, thus increasing the circulating efficiency of cool air.

A sucked air guide passage 31 is formed on the rear surface of the refrigerator compartment 13. When the cool air circulating fan 25 is operated, air of the refrigerator compartment 13 flows to the rear part 22 of the second air cooling chamber 20, along the sucked air guide passage 31. In addition, a discharged air guide passage 32 is formed on the upper surface of the refrigerator compartment 13 to uniformly distribute air discharged through the second air cooling chamber 20 above the refrigerator compartment 13. In this case, the sucked air guide passage 31 is defined by a sucked air guide member 33. The sucked air guide member 33, having the shape of a flat plate, is installed at a position spaced apart from the rear surface of the refrigerator compartment 13 in such a way that the upper end of the sucked air guide member 33 is connected to the lower end of the partition wall 28. A plurality of sucking ports 34 are provided on the sucked air guide member 33. On the other hand, the discharged air guide passage 32 is defined by a discharged air guide member 35. The discharged air guide member 35, having the shape of a flat plate, is installed at a position spaced apart from the upper surface of the refrigerator compartment 13 in such a way that the rear end of the discharged air guide member 35 is connected to the lower end of the partition wall 28. A plurality of discharging ports 36 are provided on the discharged air guide member 35. Although the passage arrangement of the freezer compartment 12 and the first air cooling chamber 20 provided at a position above the freezer compartment 12 are not shown in the drawings, they will not be described in the following, because the freezer compartment 12 has the same arrangement and construction as that of the refrigerator compartment 13.

Figure 3:
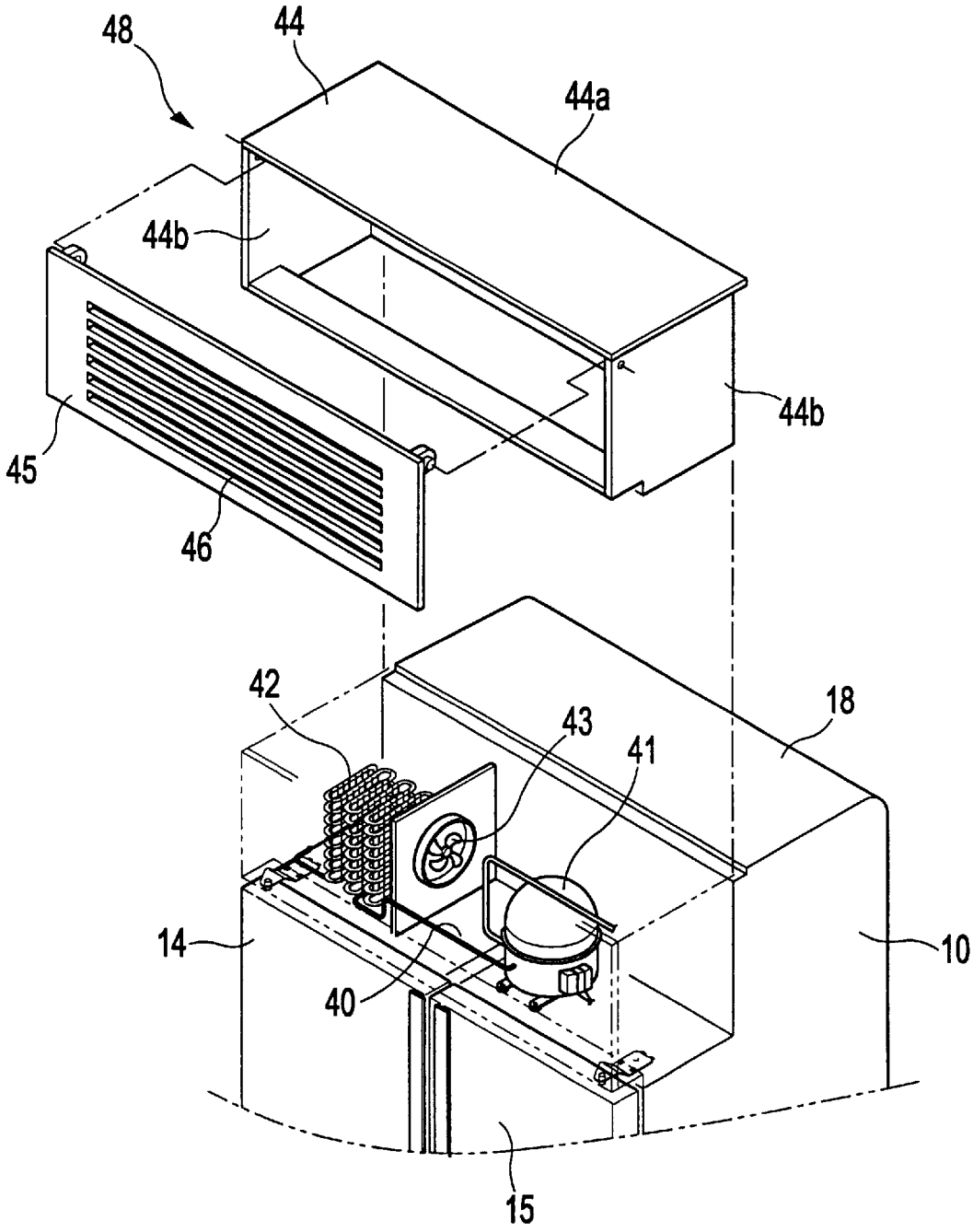
FIG. 3 is a perspective view showing a machine room included in the refrigerator of FIG. 1.

As shown in FIG. 3, the machine room 40 includes a casing 48. The casing 48 comprises a cover member 44 and a shutting member 45. The cover member 44 has an upper wall 44*a* and both side walls 44*b*. The upper wall 44*a* and the both side walls 44*b* are made of a single board material so as to fabricate the cover member 44 in the form of an integrated body. The rear edge of the upper wall 44*a* and the lower edges of the side walls 44*b* are mounted to the cabinet 10. The shutting member 45 opens or closes the open front of the cover member 44. In this case, the shutting member 45 is rotatably mounted, at its two upper corners, to the cover member 44. The shutting member 45 is provided on its front surface with a plurality of ventilation holes 46 so as to allow air to be freely circulated. The compressor 41 and the condenser 42 are installed in the machine room 40. The cooling fan 43 is installed at a position between the compressor 41 and the condenser 42 to cool them.

The cool air circulating operation of the refrigerator according to the present invention is shown in FIG. 2.

When the cool air circulating fan 25, installed in the second air cooling chamber 20, is operated, air of the refrigerator compartment 13 flows into the sucked air guide passage 31 through the sucking ports 34 of the sucked air guide member 33 which is provided behind the refrigerator compartment 13. While the air passes the evaporator 24 provided in the rear part 22 of the second air cooling chamber 20, the air is cooled. Next, the cool air passes the front part 21 of the second air cooling chamber 20 and is fed back to the refrigerator compartment 13 along the discharged air guide passage 32, by the operation of the cool air circulating fan 25. According to the present invention, since cool air is discharged through the discharging ports 36 provided on the upper surface of the refrigerator compartment 13 in a shower method, the cool air is smoothly circulated.

Further, according to the present invention, since the second air cooling chamber 20 is longitudinally arranged in a horizontal direction and the cool air circulating fan 25 comprises a cross flow fan, the cross-sectional area of the passage is not dramatically changed and air is smoothly circulated even when air flowing into the second air cooling chamber 20 through the sucked air guide passage 31 is blown into the discharged air guide passage 32. That is, since there is little laminar flow of air, cool air is smoothly circulated and the cooling efficiency of the refrigerator compartment 13 is enhanced. Since the cool air circulating process of the freezer compartment 12 is equal to that of the refrigerator compartment 13, it will not be described herein.

As is apparent from the above description, the present invention provides a refrigerator, which is designed such that an air cooling chamber is provided on the rear portion of the upper portion of a cabinet and a machine room is provided on the front portion of the upper portion of the cabinet, thus maximizing the interior capacity of the lower portion of a storage compartment which is easier to use.

Further, the present invention provides a refrigerator, which is designed such that the air cooling chamber is longitudinally arranged in a horizontal direction and an air circulating fan comprises a cross flow fan, thus minimizing the flow resistance when cool air flows in the air cooling chamber, therefore enhancing the circulating efficiency of cool air and the cooling efficiency.

Although a few preferred embodiments of the present invention have been shown and described, it would be appreciated by those skilled in the art that changes may be made in these embodiments without departing from the principles and spirit of the invention, the scope of which is defined in the claims and their equivalents.

What is claimed is:

1. A refrigerator, comprising:

a cabinet provided with a storage compartment;

a projecting part upwardly projected from a predetermined position on an upper portion of the cabinet to define an air cooling chamber, said air cooling chamber being defined in an upward direction from an upper portion of the storage compartment;

an evaporator and a cool air circulating fan installed in the air cooling chamber defined in the projecting part; and a machine room provided on the upper portion of the cabinet at a position separate from the projecting part, and including a compressor and a condenser.

2. The refrigerator as set forth in claim 1, wherein said projecting part is at a rear position on the upper portion of the cabinet such that the air cooling chamber is longitudinally and horizontally arranged at a rear position above the storage compartment, and said machine room is provided in front of the projecting part.

3. The refrigerator as set forth in claim 2, wherein said air cooling chamber is provided with a partition wall to partition the air cooling chamber into a front part and a rear part, said partition wall being spaced at an upper end thereof apart from a top surface of the air cooling chamber, and said evaporator and cool air circulating fan are installed in the rear part of the air cooling chamber.

4. The refrigerator as set forth in claim 3, wherein said cool air circulating fan is above the evaporator so as to blow cool air, generated by the evaporator through a heat-exchanging process, into the front part of the air cooling chamber.

5. The refrigerator as set forth in claim 4, wherein said cool air circulating fan comprises a cross flow fan which is longitudinally arranged along the air cooling chamber.

6. The refrigerator as set forth in claim 3, further comprising:

a sucked air guide member spaced apart from a rear surface of the storage compartment in such a way that an upper end of the sucked air guide member is connected to a lower end of the partition wall, said sucked air guide member defining a guide passage to guide air of the storage compartment into the rear part of the air cooling chamber, with a plurality of sucking ports provided on the sucked air guide member; and a discharged air guide member spaced apart from an upper surface of the storage compartment in such a way that a rear end of the discharged air guide member is connected to the lower end of the partition wall, said discharged air guide member distributing cool air discharged through the front part of the air cooling chamber, with a plurality of discharging ports provided on the discharged air guide member.

7. The refrigerator as set forth in claim 2, wherein said machine room comprises a casing including:

a cover member mounted to the upper portion of the cabinet to cover a top and both sides of the machine room; and a shutting member rotatably mounted to the cover member to selectively open or close a front of the cover member.

8. The refrigerator as set forth in claim 7, wherein said shutting member is provided with a plurality of ventilation holes.

9. The refrigerator as set forth in claim 1, further comprising a cooling fan in the machine room to cool the compressor and the condenser.

10. The refrigerator as set forth in claim 1, wherein said projecting part is integrated with the cabinet.

11. A refrigerator, comprising:

a cabinet defining a freezer compartment and a refrigerator compartment at both sides, respectively, of an interior thereof;

a projecting part upwardly projected from a rear portion of an upper portion of the cabinet to define a first air cooling chamber for the freezer compartment and a second air cooling chamber for the refrigerator compartment, respectively, said first and second air cooling chambers being defined in upward directions from rear portions of upper portions of the freezer compartment and the refrigerator compartment;

an evaporator and a cool air circulating fan installed in each of the first and second air cooling chambers; and a machine room provided on the upper portion of the cabinet at a position in front of the projecting part, and including a compressor and a condenser.

12. The refrigerator as set forth in claim 11, wherein said first and second air cooling chambers are longitudinally arranged in a horizontal direction, and each of said first and second air cooling chambers is partitioned into a front part and a rear part by a partition wall, and said evaporator is installed in the rear part of each of the first and second air cooling chambers, and said cool air circulating fan comprises a cross flow fan which is longitudinally arranged at a position above the evaporator along each of the first and second air cooling chambers.

13. The refrigerator as set forth in claim 12, further comprising:

a sucked air guide member spaced apart from a rear surface of each of the freezer and refrigerator compartments to guide air of each of the freezer and refrigerator compartments into the rear part of each of the air cooling chambers, and provided with a plurality of sucking ports; and a discharged air guide member spaced apart from an upper surface of each of the freezer and refrigerator compartments to distribute cool air discharged through the front part of each of the air cooling chambers, and provided with a plurality of discharging ports.

14. A refrigerator comprising:

a cabinet to store food;

a machine room provided on a front portion of an upper portion of the cabinet; and an air cooling chamber provided on a rear portion of an upper portion of the cabinet, wherein the machine room is separate from the air cooling chamber.

15. The refrigerator as set forth in claim 14, wherein the air cooling chamber is longitudinally provided in a horizontal direction.

16. The refrigerator as set forth in claim 15, further comprising an air circulating fan provided within the air cooling chamber.

17. The refrigerator as set forth in claim 16, wherein the air circulating fan is a cross flow fan.

18. A refrigerator comprising:

a cabinet to store food;

an air cooling chamber longitudinally arranged in a horizontal direction at a rear position above the cabinet; and a machine room provided in front of and separate from the air cooling chamber.

* * * * *